United States Patent [19]

Lazarz et al.

[11] 4,297,196

[45] Oct. 27, 1981

[54] STABLE LOW VOLTAGE MICROPOROUS DIAPHRAGM FOR ELECTROLYTIC CELLS

[75] Inventors: Christine A. Lazarz; Edward H. Cook, Jr., both of Niagara Falls, N.Y.

[73] Assignee: Hooker Chemicals & Plastics Corp., Niagara Falls, N.Y.

[21] Appl. No.: 130,766

[22] Filed: Mar. 17, 1980

[51] Int. Cl.[3] ..... C25B 13/04; C25B 13/08

[52] U.S. Cl. ..... 204/296; 204/252

[58] Field of Search ..... 204/296, 252

[56] References Cited

U.S. PATENT DOCUMENTS

| | | | |
|---|---|---|---|
| 3,281,511 | 10/1966 | Goldsmith | 264/49 |
| 3,518,332 | 6/1970 | Sklarchuk et al. | 264/49 |
| 3,556,161 | 1/1971 | Roberts | 264/49 X |
| 3,890,417 | 6/1975 | Vallance | 264/49 |
| 3,930,886 | 1/1976 | Mesiti et al. | 264/49 X |
| 3,930,979 | 1/1976 | Vallance | 204/252 |
| 4,003,818 | 1/1977 | Juillard et al. | 204/296 |
| 4,049,589 | 9/1977 | Sakane | 264/49 X |
| 4,121,990 | 10/1978 | Boulton | 204/258 |
| 4,170,540 | 10/1979 | Lazarz et al. | 264/49 X |
| 4,224,130 | 9/1980 | Moreno et al. | 204/266 |

FOREIGN PATENT DOCUMENTS 1081046 8/1967 United Kingdom .

*Primary Examiner*—F. Edmundson

*Attorney, Agent, or Firm*—Howard M. Ellis

[57] ABSTRACT

A porous polyfluoroalkylene sheet, preferably of polytetrafluoroethylene, which is suitable for use as a stable low voltage separator or diaphragm in an electrolytic cell, such as one employed for the electrolysis of brine, without being subject to an objectionable voltage increase upon use, is of a thickness in the range of about 0.2 to 2 mm., a porosity in the range of about 70 to 90% and of pore sizes within a range up to about one mm. in diameter, with a pore size distribution such that the pores of a diameter about 0.1 micron (or less) are less than 10% of the total pore volume and the volume of those of about one to ten microns is a substantial part, e.g. 50%, of the total pore volume, and with the ratio of the numbers of such pores in the lower size range to those in the upper range being less than about 30. Limiting the 0.1 micron diameter pores in the microporous sheet helps to prevent the cell from "going high voltage" during operation and the presence of one to ten micron diameter pores improves diaphragm action while still maintaining a low resistance thereof.

Also disclosed are: a diaphragm made from a portion of such sheet material; an electrolytic cell including such a diaphragm; a method of electrolyzing brine, utilizing such a cell; and a method for testing of such sheets so as to determine suitability for use thereof as stable low voltage diaphragms in electrolytic cells.

8 Claims, 4 Drawing Figures

STABLE LOW VOLTAGE MICROPOROUS DIAPHRAGM FOR ELECTROLYTIC CELLS

This invention relates to microporous synthetic organic polymeric sheets, electrolytic cells containing such as diaphragms, electrolytic processes in which these are employed and a method for determining suitability of such microporous sheets for use in electrolytic cells. More particularly, the invention is of microporous polytetrafluoroethylene sheets of certain ranges of thickness, porosity, pore sizes and pore size distributions which are useful as diaphragms in electrolytic cells for the electrolysis of brine at stable low voltages.

It is well known that aqueous brines may be electrolyzed in diaphragm cells to produce chlorine and caustic. In the past such cells have been furnished with diaphragms of deposited asbestos to maintain separate anolyte and catholyte compartments so as to prevent or minimize the flow of chloride ions into the catholyte and to minimize back diffusion of hydroxyl ions into the anolyte, while still allowing the transfer of alkali metal ions, e.g., sodium ions, in the direction of the cathode. Such diaphragms also prevent the undesirable mixing of the gaseous products of electrolysis, hydrogen and chlorine, and prevent the reaction of chlorine and caustic which would otherwise result in the making of sodium hypochlorite.

Because of govenmental restrictions limiting the use of asbestos and because it is often desirable for the separator or diaphragm employed more effectively to inhibit the passage of chloride ion into the catholyte than does a deposited asbestos diaphragm, research has been undertaken with the object of replacing asbestos diaphragms with improved means for physically separating anolyte and catholyte, while allowing desired ionic transfer. Permselective polymeric membranes, permeable to either anions or cations, as desired, have been developed, have been patented and have appeared to be promising as replacements for asbestos diaphragms, but in commercial practice many such diaphragms were not as successful as expected. Such membranes are often weak or delicate, are subject to oxidative degradation during use and are often of relatively high electrical resistances and high costs. Additionally, when employed in the electrolysis of an aqueous brine to produce chlorine and caustic, they often require that the brine employed be saturated, as by solid salt, and additionally may require that hardness ions, such as calcium and magnesium, be removed, as by ion exchange.

Among alternative separators that have been found useful are microporous synthetic organic polymeric diaphragms, for example, those made from polytetrafluoroethylene. To be acceptable such diaphragms, in use, should be satisfactorily electrically conductive, stable in physical and electrical properties in the electrolyte, chemically resistant to the electrolyte and of desired porosity and pore structure, as described in Ser. No. 76,884, filed Sept. 19, 1979, so that they may function as superior replacements for deposited asbestos. Also, in accordance with the present invention, it has been found very desirable for the diaphragm or microporous separator to be of a certain type of pore size distribution so as to avoid a voltage increase which otherwise often takes place during electrolysis, and the attendant high power consumption. Among the disclosures of microporous diaphragms and methods for their manufacture which are considered to be relevant to the subject matter of this application there may be mentioned those in French Pat. No. 1,491,033 and U.S. Pat. Nos. 3,281,511, 3,518,332, 3,556,161, 3,890,417, 3,930,886 and 4,049,589.

French Pat. No. 1,491,033 describes the manufacture of porous diaphragms by mixing together an aqueous dispersion of polytetrafluoroethylene, pore former (starch or calcium carbonate) and inorganic insoluble filler (barium sulfate, titanium dioxide or asbestos), coagulating the dispersion and converting the coagulum into sheet form, after which the pore former is removed. U.S. Pat. No. 3,281,511 discloses the preparation of microporous polytetrafluoroethylene resin sheets by mixing together finely divided polytetrafluoroethylene resin powder, in a Stoddard solvent carrier, with a minor proportion of a leachable particulate material, milling the mixture to sheet form, drying the sheet to remove the solvent, leaching out the particulate material, washing the sheet and drying it. U.S. Pat. No. 3,518,332 describes the manufacture of a microporous fluorocarbon polymer sheet from a mixture of fluorocarbon polymer, metallic salt particles and paraffin wax, removal of the wax by treatment of the sheet with a petroleum solvent, sintering of the fluorocarbon polymer particles together and leaching out of the pore-forming metallic salt particles. U.S. Pat. No. 33,556,161 teaches the manufacture of a microporous polytetrafluoroethylene sheet of certain A and B X-ray ratio characteristics by a milling process like that of U.S. Pat. No. 3,281,511.

U.S. Pat. No. 3,890,417 relates the preparation of an aqueous slurry or dispersion comprising polytetrafluoroethylene particles and a solid particulate additive material, calendering such a mix to sheet form and soaking it in a solvent for the additive so as to remove such additive. U.S. Pat. No. 3,930,886 describes porous fluorocarbon polymer matrices wherein a continuous phase of sintered fluorocarbon polymeric material has within it a series of integral interconnecting pores and a discontinuous colloidal mineral phase deposited in or at the surfaces of said pores and uniformly arranged between the major surfaces of the matrix. U.S. Pat. No. 4,049,589 teaches the production of a porous polytetrafluoroethylene sheet by rolling a sheet made from a mixture of polytetrafluoroethylene resin particles and lubricant so as to stretch it, after which the resin particles are sintered together. Although the stretching operation may be carried out before or after removal of lubricant from the sheet it is preferred that it be conducted afterward. If pore-forming materials are present in the stretched sheet they may be removed by solvent extraction, heating, dissolving or other suitable means.

Of the mentioned patents some include descriptions of particle sizes of the pore-forming material, when present. However, although there exists a relationship between the sizes of the leachable or otherwise removable pore-forming particles and sizes of the pores formed in the microporous sheet or diaphragm made, of the mentioned patents only U.S. Pat. Nos. 3,281,511, 3,930,886, and 4,049,589 mention pore sizes. In U.S. Pat. No. 3,281,511 pore sizes of finished sheet materials are described which range from sub-micron to about 100 microns (in diameter or effective diameter). In U.S. Pat. No. 3,930,886 the pores are said to have an average diameter of from about 0.5 to 10 microns and in U.S. Pat. No. 4,049,589 pore diameters are mentioned which are no greater than 5 microns. In this last patent it is reported that an accurately controlled pore size distribution is obtainable. In the examples of U.S. Pat. No.

4,049,589 pore diameters are described ranging from 0.2 or 0.3 micron to 10 microns and the pore size distribution is characterized as being substantially normal. None of the mentioned patents reciting pore sizes and/or pore size distributions teaches the regulation of pore sizes so as to minimize pores of about 0.1 micron diameter, increase or maximize the number of pores of about 1 to 10 microns diameter and have certain volume and number ratios between pores of such sizes or within certain ranges about such sizes. Certainly, none teaches the importance of regulating such pore sizes to obtain effective separators or diaphragms and to minimize such diaphragms becoming of startlingly increased resistances and causing the impressing on the electrolytic cells containing them of higher voltages (and consequent greater power consumption) to maintain a constant rate of electrolysis as the electrolytic process continues. The present invention is of separators or diaphragms which are effective in maintaining separate the aqueous anolyte and catholyte of an electrolytic cell for the electrolysis of brine to produce chlorine and caustic, while keeping the diaphragm resistance low and preventing it from "going high voltage" as electrolysis continues.

In addition to the prior art discussed above it is considered that U.S. Pat. No. 4,170,540 and U.S. patent application Ser. Nos. 957,515, 64,615, 64,616 and 76,884 are also of interest. In the patent and in all of said applications the present coinventors are the coinventors or are coinventors with third parties. Such disclosures are not admitted to be prior art against the present application but are referred to herein as sources of relevant information and are incorporated herein by reference. U.S. Pat. No. 4,170,540 describes the use of a nonionic fluorosurfactant lubricant with a fluorocarbon polymer and a pore-forming particulate material for the manufacture of microporous separators by milling, sintering the fluorocarbon polymer particles together and removing the pore-forming material by leaching. Ser. No. 64,616 is a continuation-in-part of the patent. In Ser. No. 957,515, filed Nov. 3, 1978, now abandoned, a separator is described which results in higher current efficiencies in the operation of an electrolytic cell, due to its specified porosity, thickness, hysteresis characteristics and pore size distributions. Ser. No. 76,884 is a continuation-in-part of Ser. No. 957,515. In Ser. No. 64,615, filed Aug. 7, 1979, there is described the manufacture of a microporous polytetrafluoroethylene separator which is of improved tensile strength in a longitudinal direction (a direction of motion of the sheet during milling or calendering). In these applications sizes of the pore-forming particles are given. In particular, Ser. Nos. 957,515 and 64,616 describe microporous electrolytic cell separators capable of producing alkali metal hydroxide at a current efficiency in the range of about 85 to 98%, having porosity, thickness, hysteresis and pore size distributions in certain ranges. To satisfy the conditions of such application the pore sizes are between 4 millimicrons and 34 microns, at least 85 or 86% of said pores have a diameter between 0.12 and 33 microns and at least 60% of said pores have a diameter between 0.59 and 33 microns. Such pore size ranges and percentages are also applicable to the present invention. Although Ser. Nos. 957,515 and 64,616 teach how to obtain high caustic current efficiencies while using microporous separators for the electrolysis of brine, it was not recognized at the time when the invention thereof was made that to prevent an electrolytic cell having a microporous separator therein from going high voltage during continuous operation it is important to maintain the ratio of the number of pores about 0.1 micron diameter to those about 1 to 10 microns diameter below a certain number or numbers, to lower or minimize the number (or pore volume) of pores of about 0.1 micron diameter and to increase or "maximize" the number of pores (or pore volume) about 1 to 10 microns in diameter. In essence, that is a discovery of the present inventors and is important in the various embodiments of the present invention herein disclosed.

In accordance with a preferred inventive aspect there is provided a microporous synthetic organic polymeric sheet, useful for the manufacture of a stable low voltage separator for an electrolytic cell, of a thickness in the range of about 0.2 to 2 mm., a porosity in the range of about 70 to 90% and of pore sizes substantially all within the range of 1 millimicron to 1 millimeter in diameter, with over 70% of the volume of the pores being of pores in the range of 0.1 to 100 microns in diameter and with over 50% of the volume of the pores being of pores in the range of 0.12 to 33 microns in diameter, and with the ratio of the number of pores in the 0.09 to 0.3 micron diameter range to the number of pores in the 0.8 to 2 microns diameter range being less than about 40. In a broader aspect of the invention the ratio of the number of pores in the 0.09 to 0.2 micron diameter range to those in the 0.8 to 20 and/or 1 to 10 micron diameter ranges will be less than 40, preferably less than 30 and more preferably, less than 20. Preferably the synthetic organic polymeric sheet is of a fluorinated polymer, more preferably a polyfluoroalkylene and most preferably polytetrafluoroethylene. Also within the invention is a diaphragm for an electrolytic cell made from a described sheet; an electrolytic cell containing such a diaphragm; a method of electrolyzing brine, utilizing such diaphragm(s) and such a cell; and a method of determining the suitability for stable low voltage operation of a particular polyfluoroethylene sheet intended for use as a diaphragm in an electrolytic cell.

The invention will be readily understood from the present specification, taken in conjunction with the drawing, in which.

Figure 1:
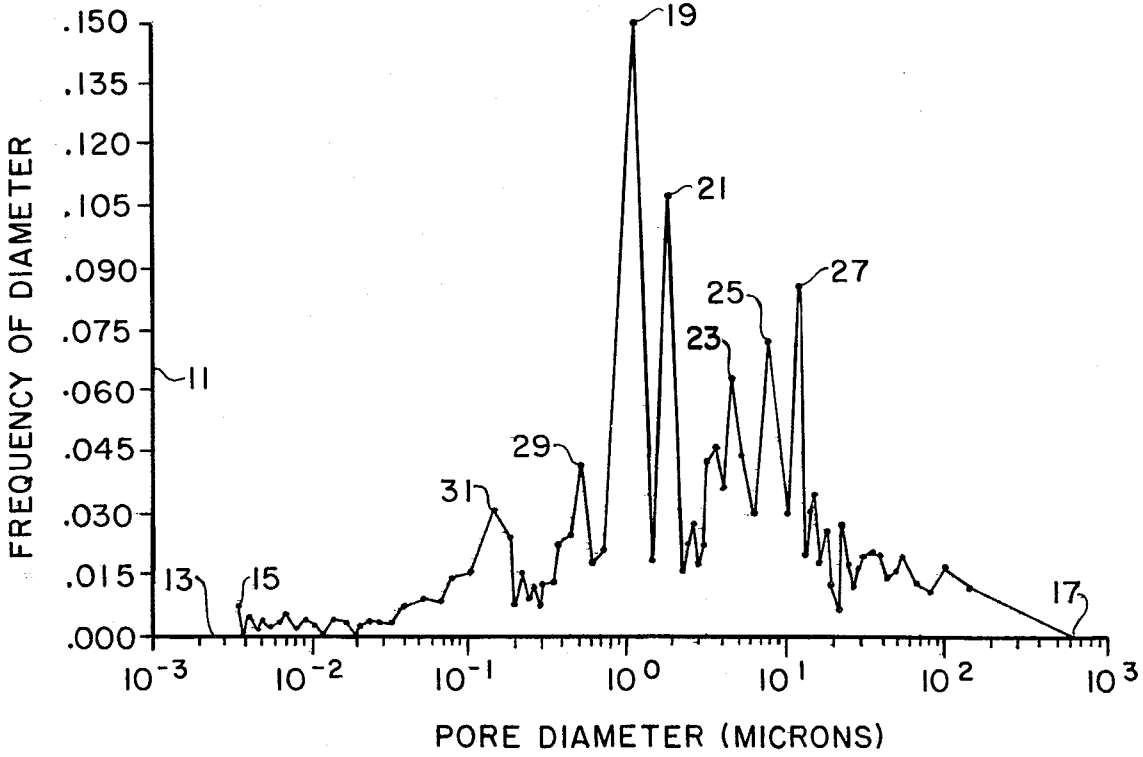
FIG. 1 is a plot of frequency of pore size versus pore size for a microporous separator of this invention.

in FIG. 1 there is plotted along vertical axis 11 the frequency distribution of the pore volume of a preferred diaphragm and along horizontal axis 13 are plotted pore diameters (average or mid-point effective diameters), in microns. The frequency distribution shown is a number resulting from use of the porosimeter (not a percentage) and it is proportional to the volumes of pore sizes indicated. Assuming that the pores are cylindrical, one can calculate that the pore volume $V=\pi D^2LN/4$, where $D$=pore diameter (average), $L$=thickness of separator and $N$=number of pores of $D$ diameter. Thus, $N=4V/\pi D^2L$. This model assumes a straight through pore without tortuosity. While this is known not to be the case, the model is used only as a means to illustrate a relationship between pores of various sizes. When L is fixed V may be replaced by the frequency from the porosimeter analysis and N will then be the pore density or number of pores per unit area. It is seen from the plot of FIG. 1 that substantially all, approximately 100%, of the pores are of diameters in the range of 1 millimicron to about 0.5 millimeter and no pores are over 1 millimeter in diameter. In FIG. 1 the minimum pore diameter plotted is shown at 15 and the proportion thereof with respect to the total pore volume is less than 1%. The largest pore diameter, as indicated on the plot at 17, is about 0.6 mm. and the frequency thereof is about 0.002 or less. From the graph it is seen that the peak pore diameter is about 1 micron and the frequency thereof present is about 0.15, shown at 19. At 21, 23, 25 and 27 are shown similar sub-peaks, indicating the frequencies of pore diameters at about 2, 5, 8 and 15 microns, and at peaks 29 and 31 are shown frequencies at about 0.5 and 0.15 micron, respectively. Thus, the graph shows that for the sample of microporous sheet in which pore size diameter distribution was measured (and in similarly acceptable sheets) the pores are mostly, usually over 90 or 95% by volume, within the 0.1 to 100 microns range, in which range over 80 or 85% and often over 90% by volume of the pores are of a pore size diameter in the range of about 0.12 to 33 microns and the sizes may be concentrated at 0.4 to 20 microns. Preferably at least 60% of the pore volume will be in pores of diameters between 0.59 and 33 microns. Sometimes the 0.12 to 33 microns pore size range may be extended to from 0.004 to 34 microns. The described sheets are of a thickness in the range of 0.2 to 2 mm., preferably being 0.7 to 1 mm. and are of a porosity of about 70 to 90%, preferably 75 to 90%. The pores of about 0.1 micron diameter (0.09 to 0.2 or 0.3 micron, for example) are less than 10% of the total pore volume and the pores of about 1 micron diameter (0.8 to 2 microns, for example) represent more than 10% and often more than 20% of the total pore volume.

Figure 2:
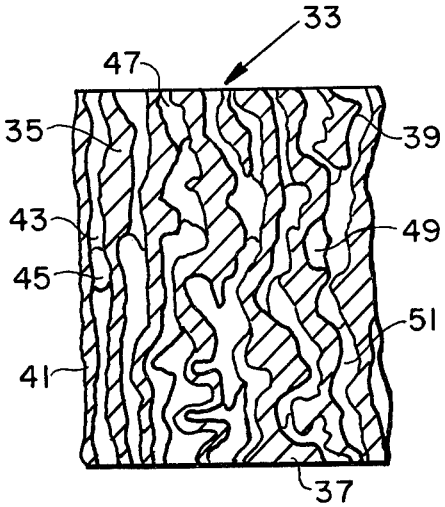
FIG. 2 is an enlargement, such as a simulated microphotograph, of a cross-section of a part of a sheet of this invention, showing the interconnected pore structure thereof.

In FIG. 2, wherein there is represented a sheet such as that of the pore sizes shown in the graph of FIG. 1, sheet 33 includes wall portions (cross-sectioned) 35, 37, 39 and 41, for example, and interconnected pores, such as those represented by numerals 43, 45, 47, 49 and 51. In the illustration it will be noted that for the purpose of illustration the sizes (diameters) of the interconnected pores and (thicknesses) of the separating walls have been exaggerated, and the thicknesses of the walls have been further exaggerated with respect to the pore diameters.

Figure 3:
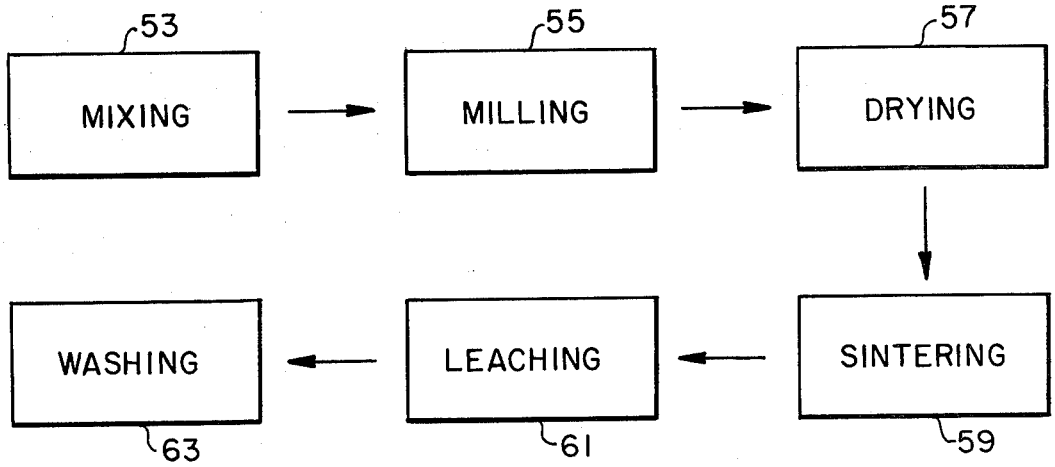
FIG. 3 is a processing or flow diagram, showing steps in the manufacture of the porous sheets of this invention.

In FIG. 3, the flow diagram, there are represented the various steps in the manufacture of a microporous sheet or diaphragm material in accordance with the present invention. Thus, initially the various components of the mixture to be converted to sheet form, including polytetrafluoroethylene resin powder in sinterable form, particulate pore-former and lubricant or contact promoting agent, are mixed together in a blending apparatus, such as a vee or twin shell blender, in a mixing operation, represented by numeral 53, after which the mix is milled in a milling operation 55. Such milling may be in a rubber mill or standard two-roll mill or may be in a multiple-roll mill wherein the milling and/or calendering is/are effected, accompanied by continuous transfer of the sheet to subsequent rolls, with sequential diminutions in sheet thicknesses. After completion of milling and removal of the sheet from a mill roll, as by a knife, the sheet is dried to remove any volatile materials present, which could otherwise interfere with the subsequent sintering operation. Such drying is effected at an elevated temperaure which is below the sintering temperature for the polytetrafluoroethylene resin particles. After completion of drying step 57 the sheet is sintered by subjecting it to an elevated temperature sufficiently high for the polytetrafluoroethylene particles to fuse together at contact points, but not high enough to cause them to melt and run together. Sintering operation 59 can be carried out between heating plates or may be effected continuously by passing the sheet between heating rolls, which preferably are also provided with cooling sections so that upon removal from contact with such rolls the sheet does not become objectionably distorted. The cooled sheet, from which volatiles have been removed but which still contains the removable particulate pore-forming material, is then subjected to a leaching operation 61, whereby the pore-forming particles are removed, after which the leaching medium is removed in washing operation 63. No separate cooling step is illustrated in the flow diagram between the sintering and leaching operations but it is understood that in following normal practice, before further processing of the material it will be cooled. Similarly, the drying operation may be conducted as a preliminary part of the sintering process. Also the washed sheet may be used directly, may be stored moist or may be dried before use, and sometimes washing may be omitted.

Figure 4:
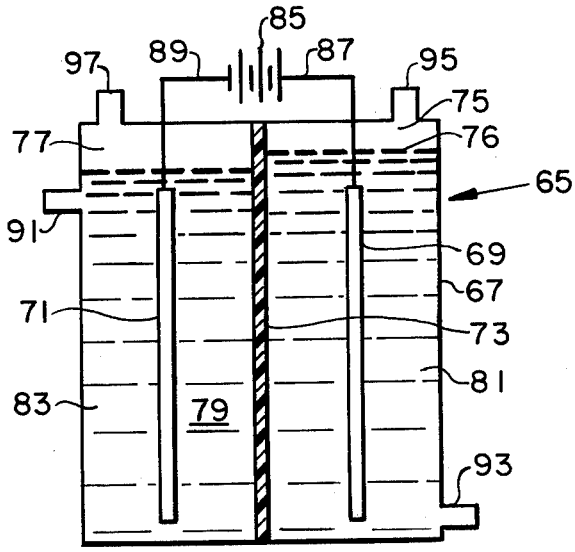
FIG. 4 is a schematic illustration of an electrolytic cell for the electrolysis of brine, with a diaphragm of this invention in place therein.

In FIG. 4 there is schematically illustrated an electrolytic cell 65 for the electrolysis of brine, which includes cell body 67, anode 69, cathode 71 and microporous diaphragm 73 (of this invention), separating the cell into anolyte compartment 75 and catholyte compartment 77, with electrolyte 79 therein, including anolyte 81 and catholyte 83. A source of direct current 85 is connected to the electrodes by conductors 87 and 89. Sodium hydroxide solution produced at cathode 71 is withdrawn through exit 91 and brine is added through inlet port 93. Chlorine is removed through outlet 95 and hydrogen is taken off through outlet 97. Water and/or sodium hydroxide solution may be added through line 91, at least on initial startup, and if desired, a separate line may be included for such additions. Surface 76, represents liquid flow head.

Polytetrafluoroethylene (PTFE) is the highly preferred polymer of this invention but it is also within the invention to utilize various other synthetic organic polymers that are thermoplastic or otherwise capable of being sintered, as described herein. Such polymers are preferably fluorinated or per-fluorinated but polychlorofluoroethylenes and poly-lower alkylenes (of 2 to 4 carbon per alkylene) are also useful. Among the homopolymers and copolymers are polychlorotrifluoroethylene, polyfluoroethylenepropylene, polyfluoro lower alkoxyethylene and copolymers of chlorotrifluoroethylene and ethylene. Also useful are polyvinyl fluoride and polyvinylidene fluoride and in some instances such polymers (or the corresponding resins) may be mixed with corresponding chlorides. Among other polymers which may sometimes be utilized, either in whole or in part, are polyvinyl chloride, post-chlorinated polyvinyl chloride, polyethylene, polypropylene and polysulfones. However, because the fluoropolymers have much greater resistances to severe electrolytic cell conditions their life expectancies are much greater than those of the other polymers and for this and other reasons they are highly preferred, especially the polyperfluoro lower (2–4 carbon atoms) alkylenes, e.g., PTFE.

For simplicity in the description of this specification, although various other polymers may be utilized too, reference will be to the polymer of choice, polytetrafluoroethylene (PTFE). PTFE and the other useful polymers will be sufficiently polymerized to maintain their solid characteristics in the media in which they are to be employed. Thus, for example, the molecular weight of the polymer will usually be from 500,000 to 10,000,000, preferably being from 1,000,000 to 3,000,000, e.g., 2,500,000 for PTFE.

The PTFE used will usually be of particle sizes in the range of from about 10 microns to about 1,000 microns (and sometimes higher), which may average about 20 to 700 microns in diameter (weight average). Such material is available from E. I. DuPont de Nemours & Co. as, for example, Teflon ®TFE-Fluorocarbon Resin 6A and Teflon TFE-Fluorocarbon Resin 7A, which average about 500 and 35 microns, respectively. Surprisingly, such products which are of low average particle sizes, such as the 7A, have been found suitable for processing by the present milling and calendering techniques, whereas such materials were previously used mainly in molding processes.

The solid particulate pore-forming material utilized is one which is insoluble in the PTFE and any lubricant employed and is preferably one which is also insoluble in water. However, it is removable by suitable chemical and/or physical means which will not damage the PTFE, such as by leaching with a mineral acid, e.g., hydrochloric and/or nitric acids, or by vaporization of sublimation. Illustrative of the pore-forming materials are starch, for example, cornstarch and/or potato starch, and water insoluble inorganic bases, oxides or carbonates, such as calcium carbonate, colloidal alumina, metallic oxides, etc. Alternatively, water soluble additives may be utilized, such as sodium carbonate, sodium chloride, sodium borate, etc. However, when using such materials the water content of the lubricant and the mix should be minimized. Such materials should have a well defined particle size and should be able to withstand any elevated processing temperatures without excessive decomposition or physical change. Calcium carbonate is preferably employed and the preferred $CaCO_3$ is one wherein the particles are of a weight average diameter or equivalent diameter substantially all within a range which will result in pores all being within the 1 millimicron to one millimeter diameter range, with over 90% of the volume of the pores being in pores in the range of 0.1 to 100 microns in diameter and over 80% of the volume of the pores being in pores in the range of 0.12 to 33 microns in diameter, and preferably with the ratio of the number of pores in the 0.09 to 0.3 micron diameter range to the number of pores in the 0.8 to 2 micron diameter range being less than about 40 (or 30). Preferably the volume of pores in the 0.4 to 0.7 micron range, as may be measured by porosimeter analysis techniques, is greater than the volume of pores in the 0.09 to 0.3 micron range and the particular type of a pore-forming material and the processing techniques employed are chosen accordingly. More preferably the volume of pores in the 0.1 to 0.2 micron diameter range is less than 10% of the total volume of pores and the volume of pores in the 1 to 2 micron diameter range is greater than 10% of the total volume of pores, e.g., 11 to 40%. The ratio of the number of pores in the 0.09 to 0.2 micron diameter range to the number of pores in the 0.8 to 2 micron diameter range will preferably be less than 40 or 30 and preferably also less than 40 or 30 is the ratio of the number of 0.1 to 0.2 micron pores to the number of 1 to 2 micron diameter pores.

To obtain the desired pore sizes from the pore-forming particulate material one could choose a powdered calcium carbonate or similar material of particle size distribution resulting in the pore size distribution desired. Thus, one may use pore-forming particulate material of particle sizes in the 1 to 500 microns diameter range and preferably such sizes often are in the 6.5 to 150 micron range, e.g., 20 to 100 microns in diameter.

The amount of pore-forming additive utilized will depend on the permeability or porosity desired in the final separator. Thus, the weight ratio of pore-former to polytetrafluoroethylene may be, for example, from about 10:1 to 1:1, and preferably is from about 7:1 to 2:1, e.g., 6:1 to 3:1. The porosity should be over 70% and normally is in the range of about 70 to 90 or 95%, preferably being 75 to 90%. Utilizing the method of the present invention, it has been found possible readily to obtain porosities greater than 70%, even 80% and more, without great difficulty. The thickness of the microporous sheets and diaphragms will normally be within the range of about 0.2 to 2 mm., preferably being 0.5 to 1.5 mm. and more preferably being 0.7 to 1 mm., e.g., 0.9 mm. However, thicknesses may be varied and it is within the invention to utilize laminates of the present sheets under suitable circumstances.

Although in some instances it will be possible to manufacture microporous sheets and separators by the method described in this invention but without the use of a lubricant, employment of such a lubricant or contact promoting agent is very highly desirable and facilitates manufacture of a satisfactory product. Without the lubricant greater difficulties will usually be encountered in milling and other processing operations.

Techniques have been described in the art for making porous sheets without the use of particulate pore-forming material. Such sheets and those made with pore formers are capable of being made in accordance with the present invention providing that the pore sizes and pore size distributions are controlled to be like those recited herein. When pores are created without the use of pore formers the milling and calendering operations may be effected before or after creation of the voids therein, preferably afterward. However, generally it is highly preferable to utilize both lubricant and particulate pore former, a group of the latter of which has previously been described.

Kerosene, other hydrocarbons, water and other aqueous media have been mentioned in the prior art as useful lubricants for the processing of mixtures of PTFE and pore-forming particulate solids. However, it has been found, as taught in U.S. Pat. No. 4,170,540 and Ser. No. 64,616, previously referred to herein, that fluorinated surface active agents, especially perfluoroalkyl-containing compounds of such type, are highly preferred. Also, while such materials are available as anionic, cationic and amphoteric surface active agents the corresponding nonionic surface active agents of this type are much preferred. The nonionic fluorosurfactants, such as that sold by E. I. DuPont de Nemours and Company as Zonyl ®FSN, may be considered as derivatives of conventional nonionic surface active agents or detergents which are condensation products of polyoxy lower alkylene, such as polyoxyethylene, polyoxypropylene, polyoxybutylene or mixtures thereof, with an alkanol, with the hydrocarbon chain of the alkanol being fluorinated, preferably perfluorinated. Such chain may be of any suitable length, e.g., 3 to 20 carbon atoms, and it is considered that it is preferable for it to be 6 to 14 carbon atoms long. The corresponding anionic, cationic and amphoteric products are also sold by the DuPont Company under the Zonyl trademark, as Zonyl FSP, FSC and FSB, respectively. These are corresponding ammonium fluoroalkyl phosphates, fluoroalkyl dimethyl sulfate quaternary salts and fluoroalkyl substituted betaines, respectively. The preferred nonionic surface active agent of this type is a perfluoropolyethylene glycol and it is considered best for the nonionic surface active material to contain from 3 to 30 ethylene oxide units per mol, e.g., 3 to 5 and 6 to 14.

The fluorocarbon surfactants, being organic in nature and containing fluorine, as does the polytetrafluoroethylene resin, have a tendency to orient at interfaces and it is considered that they lower surface tensions of solutions and improve the ready "wetting" of the polytetrafluoroethylene particles more than other surface active agents, such as non-fluorinated detergents and wetting agents. Also, because of their fluorine content, they possess a high degree of chemical and thermal stability. The Zonyl types of nonionic fluorosurfactants described are available in liquid form, containing 35 to 50% of solids, with the balance being an isopropanol/water diluent. Such balances do not interfere with milling or with the effects of the surface active compounds in the relatively small percentages usually employed. The fluorosurfactants assist in producing a uniform blend and dispersion of the pore-forming particles, such as those of calcium carbonate, in the PTFE resin composition being processed. Although the fluorosurfactants mentioned are highly preferred lubricants for the processing of the sheets of this invention, they may be employed in conjunction with other known lubricants for such purpose and in many instances may be replaced by them and the product resulting will still be better than other such products differently processed and of different final characteristics, because of the processing technique employed. However, the fluorosurfactant lubricants possess substantial advantages over prior art lubricants, such as those comparatively referred to in U.S. Pat. No. 4,170,540.

The proportion of lubricant in the mixture to be processed will normally be a minor one, usually being from about 2 to 25%, preferably 4 to 15%, on a solids basis (but water and alcohol may also be present with it when the pore-forming material is insoluble or substantially insoluble in such solvents). The most preferred concentration of the fluorosurfactant in the mix will usually be from 7 to 15%. The proportion of pore-former will normally be from 40 to 95%, preferably 65 to 92% of the mix and the proportion of resin will normally be from 3 to 40%, preferably 5 to 25%, also on a solids basis.

In addition to the materials mentioned, which may be the only components employed to make the sheets of this invention, it may be desirable sometimes to incorporate in the blend other ingredients which are not to be removed when the rolled sheet is treated to leach out the pore-forming substance. Examples of such components may include particulate "fillers", generally inorganic materials such as titanium dioxide, barium sulfate, asbestos, graphite and alumina. Suitably, such fillers will be of particle sizes lower than 10 microns and often such sizes will preferably be in the amicron and submicron range. The presence of such fillers may give the product additional strength and firmness and the particles may favorably modify diaphragm action. In general, the total proportion of such fillers will be from 1 to 25%, when present, preferably 1 to 10%.

The microporous sheets of PTFE of this invention are primarily intended for use as diaphragms in electrolytic cells for the electrolysis of brine to produce chlorine and caustic, but they have other applications, too. In use as a diaphragm, membrane or separator, it has sometimes been found desirable for the sheet made to have an increased tensile strength along a particular axis, as may be obtained by the process of Ser. No. 64,615, previously described. Alternatively, the processing methods of U.S. Pat. No. 3,556,161, may be employed, although the product resulting may not be as satisfactory. Improved current efficiency in the electrolytic use of the diaphragm is obtainable when it is made by the method of Ser. No. 957,515, previously mentioned. What is important in this invention is that the sheets be of the pore size range and pore size distribution recited (and of the thickness and porosity previously mentioned and of the tortuosity recited in Ser. No. 76,814) so as to avoid an objectionable increase in required voltage during prolonged cell operation.

To manufacture the present porous sheets or separators the mixture of PTFE, calcium carbonate and Zonyl FSN (or equivalent materials) is made, with or without adjuvants, and is subjected to a compression-shearing operation, such as milling (or calendering). Prior to milling the mixture may be made in suitable mixing equipment, such as twin shell blender. Initially, powdered materials may be mixed, after which liquid may be blended in but other orders of addition can also be employed. After sufficient mixing, often over a period of from 2 to 20 minutes or 3 to 10 minutes, the mixture may be fed between a pair of mill rolls so as to form a band on one or both such rolls, which band may be removed, either manually or automatically, and may be fed to other rolls, or may be lifted by suitable means from one of the banding rolls and sequentially fed between subsequent rolls in a train to continuously mill or calender the sheet in an operation in which the thickness of the sheet is diminished to desired measurement. Normally, mixing times before feeding to the rolls may be those mentioned above but in some instances it is possible to feed the components to the mill and to depend on the milling action to blend them together. It is possible to employ only a two roll mill, repeatedly removing the milled sheet and passing it through a subsequent gap between the rolls to subject it to further working and, in some cases, to orientation. In various prior art methods, after milling the sheet could be folded over on itself one, two or three times and often might be rotated 90° or other angles. The present method does not require such rotations, nor are the foldings needed. In fact, it may be desirable for the last five millings at least and sometimes for up to the last twenty millings to be coaxial so as to improve the strength of the milled sheet along its $B_2$ axis. See Ser. No. 64,615 for a description of such and other sheet axes, and see U.S. Pat. No. 4,170,540 and Ser. Nos. 957,515, 64,616, 76,884 and 64,615 for manufacturing methods. It will be seen that by utilizing sequentially faster moving rolls, which will take up the item being milled or calendered, one can produce the present sheets without the need for manually removing them from the rolls and subjecting them to folding and rotational movements. Also, in addition to the operations being simpler and being more appropriate for automatic running and control, the product resulting is better and of greater tensile strength along a desired axis. However, cross-milling and rotations of the axes of the milled sheets during the milling process may also be employed when it is desired to make the sheets resulting of approximately the same tensile strengths along major sheet axes and such operations can be effected automatically too, but with a more complex sheet path to be followed.

Various speeds of the working operations may be employed and various reductions of sheet thicknesses may be effected but usually the linear speed of the material coming off the mill rolls will be about 1 to 50 meters per minute, preferably about 1.5 to 5 meters per minute, and the ratio of the linear speeds of two adjacent rolls will be in the range of 1:1 or 1.05 to 5:1, preferably being 1:1 to 1.5:1 or 2:1. Instead of employing a mill of the multiple roll type, other such mills or calenders, with fewer or more rolls, e.g., 3 to 20 rolls, may also be utilized, as may be a series of two roll mills or calenders or the same rolls may be re-used. Also, other means for effecting comparable shear and compression may be substituted, such as crowning a roll or changing the surface characteristics thereof.

After production of the oriented PTFE sheet it will normally be heated to drive off any volatilizable components thereof, including any water, low boiling solvents and lower boiling portions of the lubricant and of any adjuvants which may be present. Such initial heating will usually be in a temperature range of about 100° to 250° C. and will be conducted for a suitable time to effect such volatilization, which may be from about one minute to five hours, preferably from five minutes to one hour, although by the use of special techniques, such as microwave heating, much shorter times may be employed. Subsequently the PTFE particles are sintered together at a sintering temperature, usually about 340° to 360° C., for the requisite time, normally from thirty minutes to ten hours but again, by utilization of advanced heating methods, including but not limited to ultrasonic heating, such times may be shortened. Preferred sintering times are in the 1 to 5 hour range. After cooling to room temperature, in the usual case, the calcium carbonate particles or other pore-forming materials are removed by suitable processes, including dissolving and volatilizing. For calcium carbonate particles leaching with dilute hydrochloric acid, e.g., 3 to 6 N HCl, is preferred, often accompanied by leaching with dilute nitric acid, e.g., 2 to 5 N $HNO_3$. Upon termination of the leaching operation, which may take from one to twenty hours, preferably 2 to 5 hours, to make sure that all the particles have been dissolved and removed, the sheet is washed, usually with water, and is dried and ready for use. Repeated leachings and washings or rinsings may be used to remove all the particulate pore former.

The product made, which is of desired thickness, porosity and pore sizes and distributions, may be employed as a diaphragm for electrolytic cells by cutting a portion thereof to size and framing it suitably or it may be mounted about appropriate cathode fingers or other electrode shapes or parts. After manufacture of the microporous sheets by the present method the quality of the product can be checked with a porosimeter and the products of the described processes (and of other processes) may be evaluated to determine whether they have the desirable pore sizes and distributions so as to be suitable for use as stable low voltage microporous diaphragms for electrolytic cells for the electrolysis of brine.

The microporous diaphragm of this invention, satisfying the pore size and distribution specifications recited herein, after being made wettable, is employed in a chlor-alkali cell as a diaphragm or membrane separating the anolyte from the catholyte and thereby forms an anode compartment (or anolyte compartment). Although the cell may be made of various materials, steel, glass, bitumen or synthetic organic polymeric plastic interiors are preferred and if the interior is plastic lined the lining is preferably polyvinylidene chloride or chlorinated PVC. Alternatively, solid plastic cell bodies may be employed, such as those of polypropylene or PVC. The anode is preferably of a noble metal oxide coated onto a valve metal mesh (so-called dimensionally stable anodes or DSA) and the cathode is preferably a perforated steel plate, although graphite and iron cathodes are also useful. The voltage impressed, the cell voltage, will usually be between 2.6 and 5 volts, preferably 2.6 to 4 or 3 to 4 volts and the current efficiency (so-called caustic current efficiency) will be in the range of 70 to 98%, preferably 85 to 98%. The current density is in the range of 0.1 to 0.3 ampere/sq. cm. The brine fed to the cell will usually have a concentration of from 250 to 320 g./l. of sodium chloride and may be acidic, at a pH of 2 or 3 to 5 or 5.5, but can also be of higher pH, up to 11.5. The anolyte will usually be of an acidic pH and the sodium hydroxide solution taken off is of from 90 to 180 g./l. NaOH, usually 100 or 120 to 160 or 180 g./l. The greatest favorable effect of the present invention, with respect to constant low voltage operation, is at 150 g./l. NaOH operation. The kilowatt hours per electrochemical chlorine unit (kwh/e.c.u.) may be in the range of 2,000 to 4,500, preferably being 2,000 to 3,500.

In the mentioned electrolytic cell uses it is found that the present microporous separators satisfactorily replace conventional asbestos diaphragms and prevent undue mixings of anolytes and catholytes, while allowing transfer of anolyte, sodium chloride electrolyte, through them toward the cathodes. The separators of this invention withstand the conditions of use in the electrolytic cell and because of their pore sizes and pore size distribution the cells may be operated continuously without an objectionable increase in cell voltage, which has been noted with other microporous diaphragms wherein the proportion of pores of lower diameters is greater. It has been found to be important that the volume of the pores of a size about 0.1 micron (ranges were previously given) should be limited as described and the volume of pores of sizes about 1 micron or more be greater than normal so that a desirable, stable low voltage operation will be obtained. Additionally, it is not uncommon for a peak in the pore volume to occur in the 0.4 to 0.7 micron range and the volume of pores associated with such peak is preferably intermediate volumes for 0.1 and 1 micron pores. Furthermore, a peak of pores about 10 microns, e.g., 8 to 15 microns, is also useful in making good separators. While it is not known exactly why the improved results of this invention are obtained when the pore sizes and distributions are regulated as described it has been theorized that the diameters of the objectionably small pores are too small to carry a high liquid flux and, as caustic strength increases during operation of the cell, the flux decreases and the liquid within the diaphragm may heat up because of the electric current passing through it, to cause the smaller pores to become "unwetted" by the electrolyte. In some instances internal boiling may occur. The results of such operation can be a high resistance and high voltage diaphragm, diminishing cell efficiency and requiring more electric power. While power consumption was formerly not a vital consideration, today required energy conservation measures make the advantages of the present invention much more significant.

It has also been theorized that during operation of the cell, materials may be deposited in the smaller pores of prior art microporous diaphragms, which could further diminish the sizes thereof and promote low flux and high voltage. Similarly, such could result from shrinking of the diaphragm during use or from hardening of the diaphragm material. Whatever the cause, it has been noted that when the concentration of caustic is at about 120 g./l. or higher the tendency for the cell to go high voltage is increased. Because many diaphragm cells are operated to produce a caustic concentration greater than 120 g./. the loss of efficiency due to increase in resistance of the diaphragm is a real threat to otherwise economical operation. By utilizing the separator of this invention the cell may be operated at a voltage no higher than 5 and most preferably and most often no higher than 4, e.g., 3 to 4.

The following example illustrates but does not limit the invention. Unless otherwise stated all temperatures are in °C. and all parts are by weight.

EXAMPLE

50 Grams of polytetrafluoroethylene Teflon powder No. 7A, obtained from E.I. DuPont de Nemours & Company, are dry mixed with 247 grams of calcium carbonate (modified Dryca-flo 225AB, sold by Sylacauga Calcium Products, Inc., all the particles of which are in the range of 1 millimicron to 500 microns in effective diameter, substantially all being in the 4 millimicron to 500 micron range, with a major frequency peak at about 2 microns and lesser frequency peaks at 4, 8, 10, 20, 0.8 and 0.4 microns, in a V-shape or twin-shell blender for one minute, and then 90 milliliters of Zonyl FSN, a nonionic fluorosurfactant of the type previously described in this specification, are admixed therewith and the mixture is blended together in the blender for an additional five minutes. This material is then repeatedly milled on a two-roll mill, the rolls of which are 20 cm. wide and of diameters of 10 cm. The mill speed is 150 cm./minute (the faster roller) and the ratio of roller diameters (and lineal velocities) is 1.2:1. Steps of the milling procedure and the corresponding gap settings are given below.

| Milling Procedure | Gap Setting (mm.) |
|---|---|
| Load, band, remove single sheet | 1.1 |
| Fold in half, mill | 1.4 |
| Fold in half, mill | 1.9 |
| Thin | 1.4 |
| Thin | 1.1 |
| Thin | 0.7 |
| Fold in fourths, mill | 1.9 |
| Fold in half, mill | 2,7 |
| Thin | 2.3 |
| Thin | 1.9 |
| Thin | 1.4 |
| Thin | 1.1 |
| Thin | 0.7 |

-continued

| Milling Procedure | Gap Setting (mm.) |
|---|---|
| Fold in half, mill | 1.9 |
| Thin | 1.4 |
| Thin | 1.1 |
| Thin | 0.7 |
| Fold in half, mill | 1.9 |
| Thin | 1.4 |
| Thin | 1.1 |
| Thin | 0.7 |
| Thin | 0.3 |

After milling, the sheet is heated and is held for two hours at a temperature in the range of 100° to 250° C. (which may sometimes be a preliminary part of the sintering process) and volatiles are driven off, after which it is sintered at a temperature of 340° C. for two hours. It is then leached over a period of five hours sequentially by plural treatments with dilute hydrochloric acid (6 N) and dilute nitric acid (5 N), with intermediate water rinsings, is water washed over a period of one hour, is air dried with room temperature air over a period of two hours and is then ready for use.

The sheet resulting is checked for porosity, which is found to be about 80%, and it is also checked for pore size distribution using a porosimeter from Micromeritics, Inc. It is found that the distribution is like that of FIG. 1 (note that the peaks are for diameters that are average diameters for the size range indicated) and the ratio of the number of pores in the 0.1 micron range to those in the 1 micron range is 20.

An electrolytic cell, like that illustrated in FIG. 4, having a microporous PTFE separator prepared in accordance with this example, is employed for the electrolysis of brine. Prior to installation the separator is pre-wetted by application of an aqueous solution containing 0.1% of Zonyl FSN surface active agent. The body of the cell is glass, the anode is a titanium mesh coated with a noble metal oxide and the cathode is a perforated steel plate. The PTFE separator sheet is placed between the anode and the cathode. Sodium chloride brine, at the NaCl concentration of 320 g./l. and a pH of 4, is initially placed in both anolyte and catholyte compartments and subsequently is fed to the anolyte compartment. A current density of 0.23 ampere/sq. cm. is applied to the electrodes. Chlorine is produced at the anode and hydrogen gas and sodium hydroxide are produced at the cathode. The anolyte compartment is equipped with a hydrostatic head so that some of the brine is allowed to flow continuously through the separator during the course of the electrochemical reaction. The catholyte compartment communicates with an overflow so that sodium hydroxide produced is withdrawn thereby. The amount of caustic produced over a 16 hour time period is used for calculation of the current efficiency of the cell. Chlorine produced is vented to a scrubber and hydrogen is vented to an exhaust system. The cell operation is at a temperature of about 85° C. The cell voltage is initially 3.3 volts, while levels off after a days' operation to 3.65 volts for this 0.9 mm. thick separator. The current efficiency is found to be about 94% at 150 g./l. NaOH. The cell continues to operate, producing sodium hydroxide at a concentration of at least 120 g./l., for at least three weeks, without any increase in cell voltage, such as is otherwise obtained in comparable cells wherein the diaphragm has a significantly larger number of pores of diameters of about 0.1 micron. It is considered that the pore size distribution is the important distinction between the successful cells utilizing the diaphragms of this invention and those utilizing diaphragms containing the smaller pores (and lower percentages of pores about 1 micron in diameter). It is considered that a "triangular pore distribution" from about 11 microns to about 0.4 micron, with a high frequency of pores at the 1 micron pore size is desirable and conducive to satisfactory stable low voltage operation of the diaphragm and the maintenance of the desirably low resistance thereof. Although larger pores than 1 micron are present in the diaphragm and are useful in conveying electricity through the diaphragm, via the electrolyte, the 1 micron diameter pores are also useful because it is thought that they tend to strengthen, by means of intervening walls, the larger pores, without objectionably causing overheating, interruption of wetting and development of high resistances in the pores, such as is considered to take place in electrolytic cell diaphragms having smaller pores, of about 0.1 micron diameter, when subjected to electrolysis for the production of caustic at a concentration of about 120 g./l. or more. The cell of this example, with the described diaphragm therein, has the indicated advantages, which are attributable to its being of the indicated correct pore sizes and distribution and also to its being of the useful triangular pore distribution mentioned above.

The invention has been described with respect to illustrations and embodiments thereof but is not to be limited to these because it is evident that one of skill in the art, with the present application before him, will be able to utilize equivalents and substitutes without departing from the scope of the invention.

What is claimed is:

1. A microporous synthetic organic polymeric sheet, useful for the manufacture of a stable low voltage separator for an electrolytic cell, of a thickness in the range of about 0.2 to 2 mm., a porosity in the range of about 70 to 90% and of pore sizes substantially all within the range of 1 millimicron to 1 millimeter in diameter, with over 90% of the volume of the pores, by porosimeter analysis, being of pores in the range of 0.1 to 100 microns in diameter and with over 80% of the volume of the pores being in pores in the range of 0.12 to 33 microns in diameter, and with the ratio of the number of pores in the 0.09 to 0.3 micron diameter range to the number of pores in the 0.8 to 20 micron diameter range being less than about 50.

2. A microporous polyfluoroalkylene sheet according to claim 1 wherein the thickness is in the range of 0.5 to 1.5 mm., the recited ratio of the numbers of pores is less than 30 and the volume of pores in the 0.4 to 0.7 micron range, is equal to or greater than the volume of pores in the 0.09 to 0.2 micron range.

3. A microporous polytetrafluoroethylene sheet according to claim 2 wherein the thickness is in the range of 0.7 to 1 mm., the porosity is in the range of 75 to 90%, the volume of pores in the 0.1 to 0.2 micron diameter range is less than 10% of the total pores volume, the volume of pores in the 1 to 2 micron diameter range is greater than 10% of the total pores volume and the ratio of the number of such 0.1 to 0.2 micron diameter pores to the number of such 1 to 2 micron diameter pores is less than 40.

4. A microporous sheet according to claim 3 wherein the total volume of pores about 1 micron in diameter is greater than the total volume of pores about 0.1 micron in diameter and intermediate such total volumes is a total volume of pores of about 0.6 micron diameter.

5. A diaphragm for an electrolytic cell which comprises a portion of a porous synthetic organic polymeric sheet of a thickness in the range of about 0.2 to 2 mm., a porosity in the range of about 70 to 90% and of pore sizes substantially all within the range of 1 millimicron to 1 millimeter in diameter, with over 90% of the volume of the pores, by porosimeter analysis, being of pores in the range of 0.1 to 100 microns in diameter and with over 80% of the volume of the pores being of pores in the range of 0.12 to 33 microns in diameter, and with the ratio of the number of pores in the 0.09 to 0.3 micron diameter range to the number of pores in the 0.8 to 20 micron diameter range being less than about 50, which is suitable for use in an electrolytic cell for the electrolysis of brine, in which use a substantially stable low voltage may be continuously applied without diminution of electrolysis.

6. A diaphragm according to claim 5 wherein the microporous sheet is of a thickness in the range of 0.7 to 1 mm., the porosity is in the range of 75 to 90%, the volume of pores in the 0.1 to 0.2 micron diameter range is less than 10% of the total pores volume, the volume of pores in the 1 to 2 micron diameter range is greater than 10% of the total pores volume, the ratio of the number of such 0.1 to 0.2 micron diameter pores to the number of such 1 to 2 micron diameter pores is less than 40, the total volume of pores about 1 micron in diameter is greater than the total volume of pores about 0.1 micron in diameter and intermediate such total volumes is a total volume of pores of about 0.6 micron diameter, which diaphragm is suitable for use in an electrolytic cell for the electrolysis of brine and is employable continuously in such cell at a voltage no higher than 5.

7. A microporous synthetic organic polymeric sheet material, suitable for use as a diaphragm or separator in an electrolytic cell for the electrolysis of brine to chlorine, hydrogen and caustic, which comprises a matrix of such polymer having pores distributed throughout, which are interconnected so as to provide conductivity paths therethrough via electrolyte which may enter therein, which material is of a porosity greater than 70% and no more than about 90% and has a greater volume of pores of about 1 micron diameter than those about 0.1 micron in diameter.

8. A material according to claim 7 wherein the number of pores in the 0.09 to 0.3 micron diameter range is less than 50 times the number of pores in the 0.8 to 20 micron range and substantially all the pores are in the 1 millimicron to 1 millimeter diameter range.

* * * * *